United States Patent [19]

White et al.

[11] Patent Number: 4,498,724

[45] Date of Patent: Feb. 12, 1985

[54] CIRCUIT BOARD COMPOSITE CONNECTOR

[75] Inventors: Cyril J. White, Chandlers Ford; Christopher Joyce, Middenbury, both of England

[73] Assignee: Bicc Public Limited Company, London, England

[21] Appl. No.: 587,309

[22] Filed: Mar. 7, 1984

Related U.S. Application Data

[63] Continuation of Ser. No. 303,509, Sep. 18, 1981, abandoned.

[51] Int. Cl.[3] ..... H01R 13/39

[52] U.S. Cl. ..... 339/97 R

[58] Field of Search ..... 339/17 C, 97 R, 97 P, 339/98, 99 R

[56] References Cited

U.S. PATENT DOCUMENTS

| | | | |
|---|---|---|---|
| 3,976,350 | 8/1976 | Keglewitsch | 339/97 P |
| 4,050,772 | 9/1977 | Birnholz | 339/17 C |
| 4,141,618 | 2/1979 | Reavis, Jr. et al. | 339/97 P |
| 4,171,858 | 10/1979 | Knowles et al. | 339/99 R |
| 4,283,105 | 8/1981 | Ferril et al. | 339/97 R |
| 4,363,529 | 12/1982 | Loose | 339/97 C |

FOREIGN PATENT DOCUMENTS

| | | | |
|---|---|---|---|
| WO79/1118 | 12/1979 | PCT Int'l Appl. | 339/99 R |
| 2004425 | 3/1979 | United Kingdom | 339/97 R |

OTHER PUBLICATIONS

Ansley, "Blue Streak Cable/Connector System".

*Primary Examiner*—Joseph H. McGlynn

*Attorney, Agent, or Firm*—Buell, Ziesenheim, Beck & Alstadt

[57] ABSTRACT

A composite connector for use with a perforated circuit board is formed from a preform of electrically conductive sheet metal which is folded to form, at one end of the composite connector, a socket which will make a snap fit in a hole in a circuit board and in which a terminal pin of a circuit component can be resiliently gripped and, at the other end of the composite connector, two bifurcated contacts. The bifurcated contacts are transversely spaced apart and are of such a form that when a length of insulated wire is introduced between the limbs of each bifurcated contact, the limbs will cut through the insulating covering of the wire to effect an electrical connection with the wire at two positions spaced along its length.

10 Claims, 3 Drawing Figures

CIRCUIT BOARD COMPOSITE CONNECTOR

This application is a continuation of my copending application Ser. No. 303,509, filed Sept. 18, 1981, now abandoned.

This invention relates to circuit boards and, more particularly, to composite connectors for use with circuit boards.

One kind of circuit board that is in general use comprises a board of electrically insulating material, which board has bonded on one of its surfaces a regular pattern of strips of electrically conductive metal or metal alloy, usually but not necessarily copper, and has, extending through the board and the overlying electrically conductive metal strips, a multiplicity of holes distributed at spaced positions along the strips. Circuit boards of this kind will hereinafter, for convenience, be referred to as "a circuit board of the kind described.

In order to establish a required circuit using a circuit board of the kind described, it is the present practice to employ composite connectors, each comprising a socket and, integral with the socket, a wiring pillar. Each of a number of such composite connectors is inserted into a selected hole in the circuit board so that the socket is a snap fit in the hole and the wiring pillar upstands from that surface of the board to which the metal strips are bonded. Terminal pins of circuit components are introduced into and are resiliently gripped in selected sockets of the composite connectors from the surface of the circuit board remote from the metal strips, and the components of the circuit are electrically interconnected, as required, by wrapping wire tightly around selected wiring pillars of the composite connectors. Each wiring pillar is of rectangular cross-section and wire is wrapped around a pillar using a wrapping tool under a sufficient tension to ensure that the sharp edges of the pillar cut into the wire to effect satisfactory electrical contact. Selected pillars of the composite a connectors are usually solder to parts of the circuit board to provide for electrical connection to supply voltages or earth.

It is an object of the present invention to provide for use with a circuit board of the kind described, an improved composite connector by means of which a desired circuit can be established more rapidly and simply than when using composite connectors hitherto employed.

According to the invention, the composite connector is formed from a preform of electrically conductive sheet metal or metal alloy, e.g. copper, which is folded or otherwise shaped to form, at one end of the composite connector, a socket which will make a snap fit in a hole in a circuit board of the kind described and in which a terminal pin of a circuit component can be resiliently gripped and, at the other end of the composite connector, at least two bifurcated contacts which are transversely spaced apart and which are of such a form that when a length of insulated wire is introduced between the limbs of each bifurcated contact, the limbs will cut through the insulating covering of the wire to effect an electrical connection with the wire at at least two positions spaced along its length.

Preferably, the end of the composite connector remote from the socket is of substantially tubular form with two bifurcated contacts positioned at substantially diametrically opposed positions and with the slots bounded by the limbs of the bifurcated contacts opening into that end of the composite connector. In a preferred embodiment, the axes of the slots bounded by the limbs of the bifurcated contacts and the axis of the composite connector itself lie in a common plant. The radially inner and outer surfaces of the limbs of the bifurcated contacts are preferably substantially flat and, also, preferably lie in planes substantially normal to the common plan in which lie the axes of the slots of the bifurcated contact. The corners of each limb of each bifurcated contact are preferably radiused to reduce substantially the risk that these corners might otherwise cut into, and seriously weaken, a wire.

To limit the extent to which a terminal pin of a circuit compoenent can be introduced into the socket, preferably a part of the preform is folded or otherwise shaped to extend radially inwardly of the socket to form a stop. This stop may take the form of a tongue folded radially inwardly from a window in the wall of the substantially tubular end of the composite connector remote from the socket; this tongue may also be so positioned as to serve as a stop limiting the extent to which a length of insulated wire can be introduced into the slots of the two bifurcated contacts.

Resilient gripping of a terminal pin of a circuit component within the socket of the composite connector is preferably effected by a separately formed socket contact of electrically conductive metal or metal alloy e.g. gold-plated copper, which is a tight fit in the socket of the connector but, in some circumstances, means for resiliently gripping a terminal pin of a circuit component when introduced into the socket of the composite connector may be an integral part or of the wall of the socket.

Preferably, the composite connector is formed between its ends with an outwardly extending shoulder to limit the extent to which the connector can be introduced into a hole in a circuit board of the kind described.

The improved composite connector of the present invention has several important advantages over composite connectors hitherto proposed and used on circuit boards of the kind described. Firstly, the improved composite connector can be readily formed from a sheet metal blank and can be assembled on a circuit board using a simple hand tool or automatically from a bandolier of composite connectors. Secondly, no skill is required in electrically connecting a length of insulated wire to the composite connector and the feature of effecting electric contact at spaced positions along the wire provides for a reliable electrical connection. The necessity to strip insulation from an insulated wire is eliminated and electrical connection of an insulated wire to the composite connector can be effected more rapidly and simply than has hitherto been possible. Furthermore, when required two separate lengths of insulated wire can be introduced as one after the other into the slots of the bifurcated contacts of the improved composite connector. Since a wiring pillar is no longer employed, a circuit board of the kind described on which is assembled a circuit employing improved composite connectors of the present invention will be substantially thinner than a circuit board on which is assembled a circuit employing composit connectors having wiring pillars extending from one face of the board and, consequently, where the board is to be mounted in a cabinet or racking, there is a substantial saving of valuable space.

The invention is further illustrated by a description, by way of example, of a preferred composite connector with reference to the accompanying drawings, in which.

Figure 1:
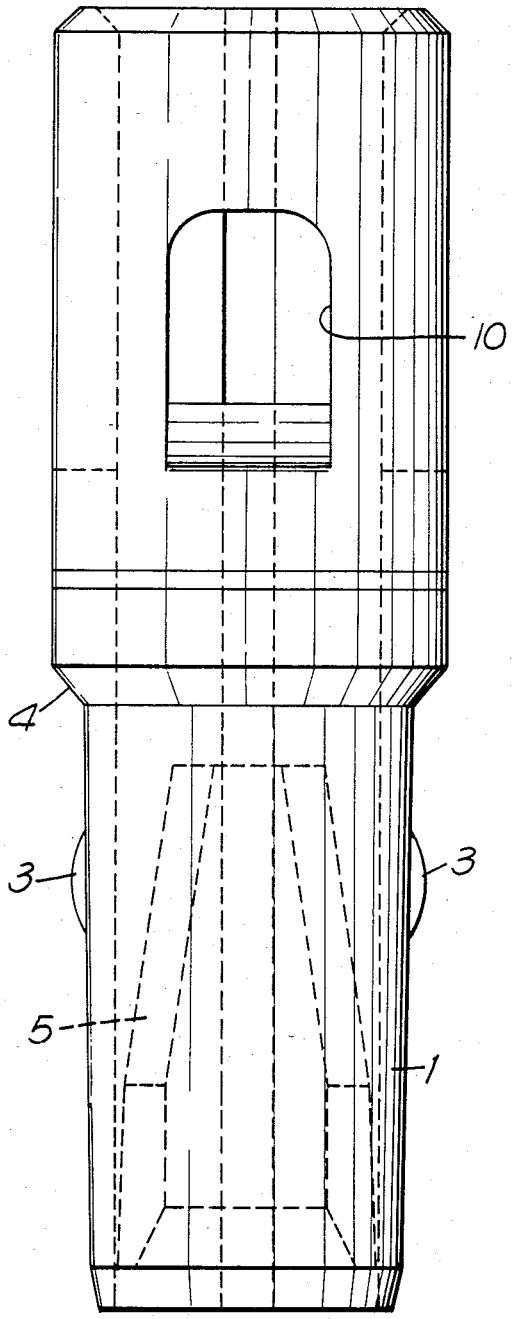
FIG. 1 is a side elevation of the preferred composite connector drawn on a greatly enlarged scale.
Figure 2:
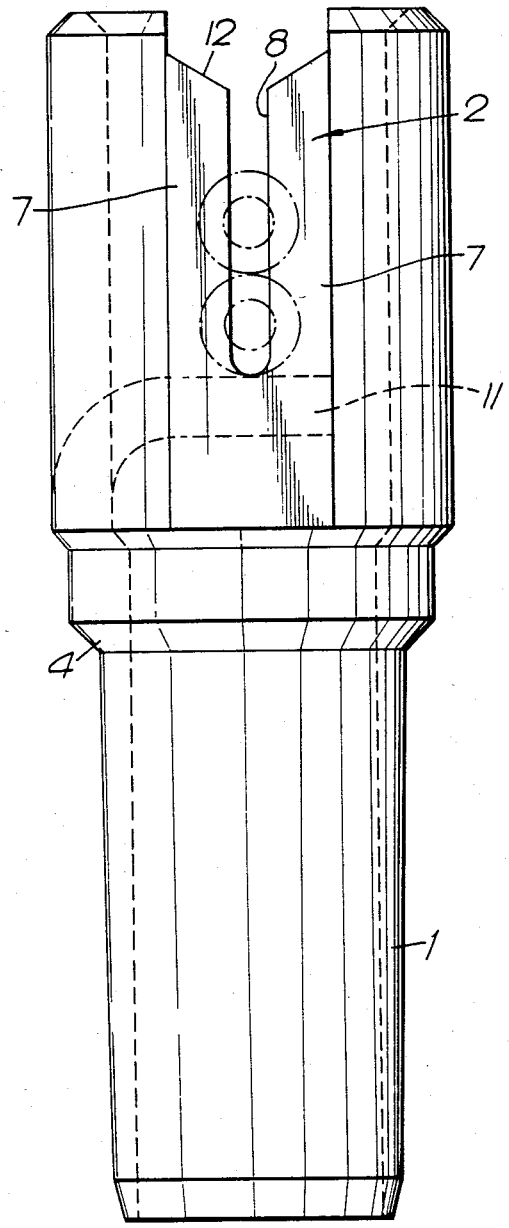
FIG. 2 is a side elevation of the composite connector shown in FIG. 1 taken at an angle of 90° to the side elevation shown in FIG. 1.
Figure 3:
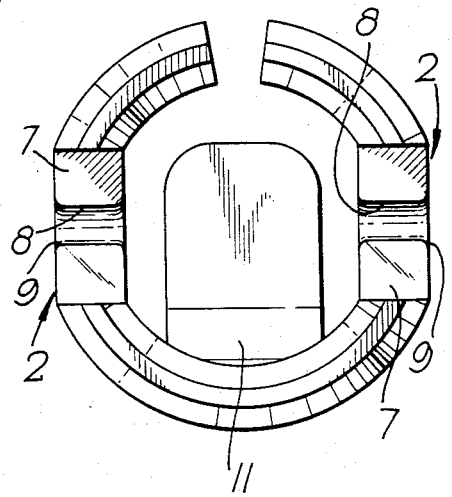
FIG. 3 is a view from above of the composite connector shown in FIG. 1.

Referring to the drawings, the composite connector is formed by folding a sheet copper blank into generally tubular form and comprises, at one end of the connector, a socket 1 for insertion into a hole in a circuit board of the kind described and, at the other end of the connector, two bifurcated contacts 2 at diametrically opposed positions around the connector. The socket 1 has at least one outwardly projecting dimple 3 for effecting a snap fit in a hole in a circuit board and, between the socket and the bifurcated contacts 2, the connector has an outwardly extending shoulder 4 for limiting the extent to which the connector can be inserted into a hole in a circuit board. Tightly fitting within the socket 1 is a separately formed gold-plated copper socket contact 5 for resiliently gripping a pin of a circuit component.

The axes of the bifurcated contacts 2 and the axis of the connector itself lie in a common plane. The limbs 7 of each bifurcated contact 2 define a slot 8 for reception of a length of insulated wire and have flat radially inner and outer surfaces that lie in planes normal to the common plane in which lie the axes of the bifurcated contacts 2. The corners of the limbs 7 of each bifurcated contact 2 are radiused at 9. At the open end of each bifurcated contact 2, parts of the limbs 7 are removed to provide a throat 12 to facilitate introduction of a length of insulated wire into the slot 8. In the wall of the tubular portion of the connector remote from the socket 1, is a window 10 from which is radially inwardly folded a tongue 11 constituting a stop limiting the extent to which a pin of a circuit compoent can be inserted into the socket.

What we claim as our invention is:

1. A composite connector for use with a circuit board of the kind comprising a board of electrically insulating material, which board has bonded to one of its surfaces a regular pattern of strips of electrically conductive metal or metal alloy and has, extending through the board and the overlying electrically conductive metal strips, a multiplicity of holes distributed at spaced positions along the strips, which composite connector is formed from a preform of electrically conductive sheet metal or metal alloy which is folded to form a tube having an open seam extending from end to end of the composite connector and which is shaped to form, at one end of the composite connector, a socket which will make a snap-fit in a hole in a circuit board and in which a terminal pin of a circuit component can be resiliently gripped and, at the other end of the composite connector, a tubular end portion of substantially circular cross-section having longitudinally extending slots which are at substantially diametrically opposed positions and whose axes lies in a plane transverse to the plane common to the axes of the composite connector and of said seam, each of which slots open into that end of the composite connector and is bounded by marginal portions of said tubular end portion, which marginal portions and the slot bounded thereby constitute the limbs and an insulated wire-receiving opening of a bifurcated contact, the limbs of each bifurcated contact having opposed faces which, over at least a major part of their widths, are substantially flat and lie substantially parallel to the transverse plane common to the axes of the diametrically opposed slots, the arrangement being such that, when a length of insulated wire is introduced into the opening between the limbs of each bifurcated contact, the limbs will displace the insulating covering of the wire to effect an electrical connection with the wire at at least two positions spaced along its length.

2. A composite connector as claimed in claim 1, wherein the radially inner and outer surfaces of the marginal portions of the tubular end portion constituting the limbs of the bifurcated contacts are substantially flat.

3. A composite connector for use with a circuit board of the kind comprising a board of electrically insulating material, which board has bonded to one of its surfaces a regular pattern of strips of electrically conductive metal or metal alloy and has, extending through the board and the overlying electrically conductive metal strips, a multiplicity of holes distributed at spaced positions along the strips, which composite connector is formed from a preform of electrically conductive sheet metal or metal alloy which is folded to form a tube having an open seam extending from end to end of the composite connector and which is shaped to form, at one end of the composite connector, a socket which will make a snap-fit in a hole in the circuit board and in which a terminal pin of a circuit component can be resiliently gripped and, at the other end of the composite connector, a tubular end portion of substantially circular cross-section having longitudinally extending slots which are at substantially diametrically opposed positions and whose axes lie in a plane transverse to the plane common to the axes of the composite connector and of said seam, each of which slots opens into that end of the composite connector and is bounded by marginal portions of the said tubular end portion, which marginal portions and the slot bounded thereby constitute the limbs and an insulated wire-receiving opening of a bifurcated contact, the limbs of each bifurcated contact having opposed faces which over at least a major part of their widths, are substantially flat and lie substantially parallel to the transverse plane common to the axes of the diametrically opposed slots and the radially inner and outer surfaces of the limbs being substantially flat and lying in spaced planes substantially normal to said transverse plane, the arrangement being such that, when a length of insulated wire is introduced into the openings between the limbs of each bifurcated contact, the limbs will displace the insulting covering of the wire to effect an electrical connection with the wire at at least two positions spaced along its length.

4. A composite connector as claimed in claim 1 or 3, wherein the corners of each limb of each bifurcated contact are smoothly curved.

5. A composite connector as claimed in claims 1 or 3, wherein the socket of the composite connector has tightly fitted therein a separately formed resilient socket contact of a metal or metal alloy of high electrical conductivity for resiliently gripping a terminal pin of a circuit component.

6. A composite connector as claimed in claim 1 or 3, wherein an outwardly extending shoulder is formed between the ends of the composite connector to limit the extent to which the socket of the connector can be introduced into a hole in a circuit board.

7. A composite connector as claimed in claim 1 or 3, wherein the socket of the connector has at least one outwardly extending protuberance to enable the socket to effect a snap-fit in a hole in a circuit board.

8. A composite connector as claimed in claim 1 or 3, wherein, to limit the extent to which a terminal pin of a circuit component can be introduced into the socket, a part of the preform is shaped to extend radially inwardly of the composite connector to form a stop.

9. A composite connector as claimed in claim 8, wherein the stop takes the form of a tongue folded radially inwardly from a window in the wall of the tubular end portion.

10. A composite connector as claimed in claim 9, wherein the tongue is also so positioned as to serve as a stop limiting the extent to which a length of insulated wire can be introduced into the openings of the bifurcated contacts.

* * * * *